US005556324A

United States Patent [19]

Shank, Jr.

[11] Patent Number: 5,556,324

[45] Date of Patent: Sep. 17, 1996

[54] BLASTING CABINET

[75] Inventor: James D. Shank, Jr., Vestal, N.Y.

[73] Assignee: Church & Dwight Co., Inc., Princeton, N.J.

[21] Appl. No.: 390,039

[22] Filed: Feb. 17, 1995

[51] Int. Cl.[6] ..... B24C 9/00

[52] U.S. Cl. ..... 451/89; 451/87; 451/88; 451/90

[58] Field of Search ..... 451/87, 88, 89, 451/90, 38, 39, 40

[56] References Cited

U.S. PATENT DOCUMENTS

| | | | |
|---|---|---|---|
| 2,321,774 | 6/1943 | Ruemelin | 451/89 |
| 2,576,008 | 11/1951 | Gladfelter | 451/89 |
| 2,797,530 | 7/1957 | Garver | 451/89 |
| 3,300,902 | 1/1967 | Dockery | 451/89 |
| 4,958,466 | 9/1990 | Howells | 451/89 |
| 5,177,911 | 1/1993 | Ruemelin et al. | 51/426 |

FOREIGN PATENT DOCUMENTS

| | | | |
|---|---|---|---|
| 1341004 | 9/1987 | Russian Federation | 451/89 |

*Primary Examiner*—Bruce M. Kisliuk
*Assistant Examiner*—Eileen P. Morgan
*Attorney, Agent, or Firm*—Irving M. Fishman

[57] ABSTRACT

An abrasive blast cabinet includes a housing defining a blast chamber, a blast nozzle disposed in the blast chamber and connected to a source of an abrasive blast media for directing a flow of the blast media against a surface of an article to be cleaned, an elongated chute supported in the interior of the housing and having a first open end in fluid communication with a gas supply, a rotatable second open end in the vicinity of a work place for the article and an opening placed adjacent a window in the housing so that an operator located outside the blast chamber can direct his or her line of sight through the window and second rotatable open end and observe the article in the work place. A ventilation means, such as an exhaust fan, is provided for removing from the blast chamber blast media dispersed therein and for directing filtered air through the chute and discharging same from the rotatable second open end in a direction toward a viewing zone in the vicinity of the article and at a velocity and volume sufficient to purge blast media dispersed inside the blast cabinet away from the article being cleaned so that the operator can view the article and the cleaning action. The air removed from the interior of the blast cabinet can be filtered and recycled to the chute. A control means is provided to control the amount of filtered air recycled to the chute.

22 Claims, 4 Drawing Sheets

BLASTING CABINET

FIELD OF THE INVENTION

The present invention relates to improvements in blast cleaning apparatus used to strip adherent material such as paint, scale, dirt, grease and the like from solid surfaces by means of a particulate abrasive. In particular, the present invention is directed to a novel blast cabinet used to clean or treat a substrate surface with an abrasive blast media.

BACKGROUND OF THE INVENTION

In order to clean a solid surface so that such surface can again be coated such as, for example, to preserve metal against deterioration, or simply to degrease or remove dirt from a solid surface, it has become common practice to use an abrasive blasting technique wherein abrasive particles are propelled by a high pressure fluid against the solid surface in order to dislodge previously applied coatings, scale, dirt, grease or other contaminants. Various abrasive blasting techniques have been utilized to remove coatings, dirt, grease and the like from solid surfaces. Thus, blasting techniques comprising dry blasting which involves directing the abrasive particles to a surface by means of pressurized air typically ranging from 30 to 150 psi, wet blasting in which the abrasive blast media is directed to the surface by a highly pressurized stream of water typically 1,000 psi and above, or blasting in which both air and water are utilized either in combination at high pressures to propel the abrasive blast media to the surface, or in combination with relatively low pressure water used as a dust control agent or to control substrate damage have been used. Water for dust control has been mixed with the air either internally in the blast nozzle or external of the nozzle at the targeted surface to be cleaned and such latter process, although primarily a dry blasting technique, is considered wet blasting inasmuch as media recovery and clean-up is substantially different from that utilized in a purely dry blasting operation.

The use of blast chambers to strip contaminants from the surfaces of articles, in particular, articles which are of relatively small size is an important technique of cleaning such articles especially if blast cleaning is done on a regular basis. For example, automobile manufacturers use blast chambers to clean auto parts such as door panels, hoods, trunk tops, bumpers, etc. which have been over or unevenly painted for repainting. Blast chambers or cabinets are useful in cleaning salvaged parts and systems before they can be disassembled, inspected and rebuilt. Auto parts rebuilders, heavy machinery reconditioners, machine tool manufacturers, the airline, railroad and trucking industries, commercial vehicle leasing and military bases and depots are all examples of users or facilities where parts cleaning is done on a regular basis and can find the use of a blast chamber or cabinet beneficial.

If blast cleaning is done on a regular basis, it is important to control noise levels, capture, examine and, if possible, recycle used abrasive media and, importantly, control the dust which is formed so as to provide for the visibility of the blast nozzle operator. Dust control in blast chambers is extremely important in view of the enclosed environment which is used for the cleaning process. In the more enclosed environment of a blast chamber, the use of a secondary water stream does not effectively control the dust and, may in fact, add to visibility problems by forming a mist which stagnates in the chamber. Thus, it is often desired to blast clean using a purely dry blast cleaning process. Unfortunately, in a dry blast cleaning process, a considerably large amount of dust engulfs the environment of the target substrate.

Blast cabinets typically include an interior chamber in which the article or articles to be cleaned or treated by an abrasive media are placed. The operator usually reaches through armholes protected by rubber gloves and, observing through a front window in the blast cabinet, either picks up an article to be cleaned and moves it under a stationary blast nozzle or picks up a portable blast nozzle and moves it about to direct a high velocity stream of the abrasive particles over the surfaces of the article. The blast media typically used with a blast cabinet is a relatively hard particulate material such as steel shot, glass beads, aluminum oxide and like materials which normally experience a limited breakdown during use and is recycled for use after removing the contaminants from the treated surface.

An alternative to the hard abrasives used as a blast media, particularly, for removing adherent coatings or other contaminants from relatively soft substrates such as softer metals as aluminum, composite surfaces, plastics, ceramic tile, and the like is sodium bicarbonate. While sodium bicarbonate is relatively soft, it is sufficiently hard to remove coatings from steel and aluminum surfaces and as well remove other coatings including paint, dirt, and grease from non-metallic surfaces without harming the substrate surface. Sodium bicarbonate is not harmful to the environment and is most advantageously water soluble such that the particles which remain subsequent to blasting can be simply washed away without yielding environmental harm.

Accordingly, fine powder abrasive materials, such as sodium bicarbonate-based materials, are preferred for some applications because they are less harsh to the surface being cleaned, are nonhazardous to persons operating or working in the vicinity of blast operation including blast cabinets and the disposal of the spent media is greatly simplified. However, dry forms of this type of material generally cannot be used in a blast media in conventional bast cabinets because the material is friable and breaks down into dust-like particles which are dispersed throughout the blast cabinet and-produce a dense, fog-like condition. This condition cannot be eliminated or adequately reduced by conventional blast cabinet ventilation technology. Consequently, the operator most often is unable to observe the article being cleaned. This is particularly true for operations using higher velocity jet streams. The addition of a liquid such as water to control dust, often as before-said does not usually solve the problem as the water tends to disperse in a manner to further obscure visibility in the area surrounding the article being cleaned.

U.S. Pat. No. 5,177,911, issued Jan. 12, 1993, to Ruemelin discloses a blast cabinet with an improved ventilation system to provide better visibility of the object being cleaned with a friable abrasive such as sodium bicarbonate. In a preferred embodiment of the invention disclosed therein, there is provided an abrasive blast cabinet including a housing defining a blast chamber, a blast nozzle in the blast chamber and connected to a source of an abrasive blast media for directing a flow of the blast media carried in a pressurized stream of gas against the surface of an article to be cleaned, window means for observing the article during cleaning including an elongated tubular member having an inner end portion located inside the blast chamber and having an inner viewing port situated so that there is a viewing zone between the inner viewing port and the article being cleaned. The tubular member also has an outer end portion including an outer viewing port through which an operator located outside the blast chamber can direct his or her line of sight through the interior of the tubular member and observe the article being cleaned. Gas delivery means directs a flow of gas into the viewing zone to purge away a sufficient amount of the blast media from the viewing zone to facilitate observation of at least that portion of the article being cleaned.

While in theory, the Ruemelin cabinet disclosed in U.S. Pat. No. 5,117,911 is an improvement over previous blast cabinets in the ability thereof to improve visibility of the blast cleaning operation, in practicality, any attempt to commercialize the blast cabinet disclosed in the Ruemelin patent does not readily achieve its proposed objectives. For one, the viewing zone is very limited when utilizing the tubular viewing port. Thus, except for telescoping means to shorten or elongate the viewing chamber, the operator is very limited as to where the article to be blasted must be placed. For larger objects, this limited viewing zone could be very disadvantageous as it may not be readily possible to turn and twist such an object and maintain the object in the viewing zone limited by the tubular member disclosed in the Ruemelin patent. Further, the Ruemelin patent does not readily discuss or disclose controlling the air pressure inside the cabinet so as to insure air flow across the viewing zone and secondly, to insure that dust does not escape from the internal chamber in the cabinet. Air is constantly entering the cabinet through the blast nozzle and from the ambient environment. Accordingly, if there is not present a vacuum or suction force which can be controlled accurately, this can result in either an insufficient amount of ambient air being drawn into the cabinet for direction across the viewing zone or, too much air may be drawn into the cabinet, pressurizing the cabinet and allowing the leakage of dust into the surrounding environment and causing a nuisance and health hazard to the operator. Thirdly, while the Ruemelin disclosure suggests treatment of the air- laden dust which is withdrawn from the cabinet such as by means of bag filters, in the present environmental climate, it is virtually impossible to remove a sufficient amount of dust from the circulating air by bag filters so as to allow the filtered air to be directed into the atmosphere. There still remains in the filtered air a considerable amount of dust which is unacceptable by present environmental laws and regulations.

Accordingly, a primary object of the present invention is to provide an improved apparatus for cleaning or finishing surfaces of articles located inside a chamber with a pressurized flow of a cleaning media including an observation arrangement which facilitates observation of the portion of the article being treated in spite of the cleaning media dust which is dispersed throughout the interior of the chamber.

Another object of the invention is to provide an improved abrasive blast cabinet which is capable of employing a dry, friable abrasive material as the blast media and at the same time provide the operator with a clear view of the article being cleaned.

Still another object of the invention is provide an abrasive blast cabinet including improved viewing means for observing the article being cleaned and which can be easily adjusted to allow the operator to move the article to be cleaned within the blast chamber and still maintain a line of sight on the portion of the article being cleaned.

Another object of the invention is to provide an improved blast cabinet which contains means to accurately control the air pressure within the interior chamber of the cabinet so as to insure the flow of gas into the viewing zone of the chamber to purge away dust dispersed within the viewing zone and also prevent the leakage of dust from the chamber into the external environment of the blast cabinet.

Still yet another object of the present invention is to treat the dust-laden air removed from the interior chamber of the blast cabinet so as to remove the dust and recycle the air into the interior chamber of the blast cabinet to purge dust from the viewing zone and to provide sufficient treatment to the dust-laden air so that a portion of the treated air can be directed into the environment and comply with clean air standards.

Other objects, aspects and advantages of the invention will become apparent to those skilled in the art upon reviewing the following detailed descriptions, the drawings and the appended claims.

SUMMARY OF THE INVENTION

The blast cabinet of the present invention is an improvement over the blast cabinet described in U.S. Pat. No. 5,177,911. As disclosed therein, the blast cabinet includes a blast nozzle means in the interior chamber of the cabinet for directing a pressurized flow of the abrasive media against the surface of an article to be cleaned, observation means for observing the article during cleaning including a viewing portion situated in the chamber such that there exists a viewing zone between the observation means and the article being cleaned, and gas delivery means for directing a flow of gas into the viewing zone to purge away a sufficient amount of the dust formed from the abrasive media which is dispersed in the viewing zone to facilitate observation of at least the portion of the article being cleaned. The observation means and the gas delivery means includes a tubular member which extends into the interior chamber of the blast cabinet such that an operator can look through the end of the tubular chamber extending from the blast cabinet and wherein a gas passing through the tubular chamber pushes away any dust in the viewing zone between the interior end of the chamber and the article being cleaned.

In accordance with the present invention, the tubular observation and gas delivery means disclosed in U.S. Pat. No. 5,177,911 is replaced by a fixed internal chute which extends from the top of the cabinet and is placed adjacent the front of the blast cabinet and, in particular, the front window of the cabinet through which the operator can observe the blast cleaning operation. The bottom end of the fixed chute includes an open-ended swivel chute which directs air being passed from the top of the fixed chute into the viewing zone between the swivel chute and the article to be cleaned so as to remove any accumulated dust in the viewing zone and allow the operator to clearly view the portion of the object being cleaned. The swivel chute can be rotated to allow the operator to view a greater portion of the internal chamber of the blast cabinet. Accordingly, the object being cleaned can be moved around the blast cabinet and still allow the operator to view the blast cleaning operation. This is an important improvement over U.S. Pat. No. 5,177,911, wherein the viewing zone was severely limited.

In another important feature of the improved blast cabinet of the present invention, an improved ventilation system is provided so as to insure the proper flow of air through the blast cabinet to remove dust from the viewing zone, prevent leakage of dust from the interior of the blast cabinet to the exterior environment and to insure that any dust-laden air which is removed from the blast cabinet is properly filtered so that the air can be directed to the ambient environment without causing any environmental harm or safety hazard and so as to comply with all air quality standards and regulations. Thus, in accordance with this invention, the dust-laden air removed from the blast cabinet is cleaned by a wet scrubbing technique whereby the dust-laden air is passed through water to collect the dust and the air which is freed from the major amount of the dust is then recycled through the fixed and swivel chutes and into the viewing zone to remove accumulated dust from the viewing zone and allow the operator to observe the blast cleaning operation. Although the recycled air passing through the fixed chute contains some dust, the quantity of dust is not sufficient to disturb the visibility of the operator. To control the air pressure within the interior of the blast cabinet, adjustable dampers are provided which control the amount of air which is recycled to the fixed chute. If too much air is being recycled, a portion of the air is passed through a bag filtering device which removes the remaining dust from the air. The twice filtered air can then be purged to the ambient atmosphere. A measurement of the air pressure in the area of the bag filtering device and the air pressure in the cabinet allows accurate control of the dampers which can be adjusted to recycle more or less air into the cabinet and into the bag filtering device and ambient atmosphere, respectively.

DETAILED DESCRIPTION OF THE INVENTION

The apparatus provided by the invention can be adapted for a wide variety of applications in which an article is cleaned inside a housing or other enclosure by directing a pressurized gas stream containing a dry cleaning media, a liquid cleaning media or a mixture of a dry cleaning media and a liquid, such as water, against a surface of the article and the spent media and/or fine droplets of liquid in mist form are dispersed in the interior of the housing in a manner which can obscure observation of the article being cleaned. It is particularly adaptable for blast cabinets and will be described in connection with that application.

Blast cabinets provided by the invention can be either the suction-type or the pressure-type and can employ a variety of abrasive blast media, including conventional hard grit blast media. The invention is particularly useful with pressure type cabinets employing powder, friable materials as the blast media, either in dry form or mixed with a liquid, such as water. Sodium bicarbonate-based blast media, such as ARMEX blast media marketed by Church & Dwight, Inc., is preferred because such materials are non-toxic and ecologically safe, do not produce an explosive dust and can scour some surfaces to a smooth finish.

Blast cabinets provided by the invention can be used for a wide variety of surface treatments, either flexible or rigid substrates, metallic or non-metallic substrates and flat or contoured surfaces. For example, blast cabinets of the invention can be used to remove grease, dirt, surface rust, aluminum corrosion, and various coatings (e.g., paints, lacquers, etc.) down to a bare substrate or one layer at a time and other surface treatments. As used herein, the terms "clean", "cleaned" and "cleaning" means all of such uses and other applications where contacting the surfaces of an article with a high velocity flow of a blast media or other liquid or cleaning media is or may be an appropriate treatment.

Figure 1:
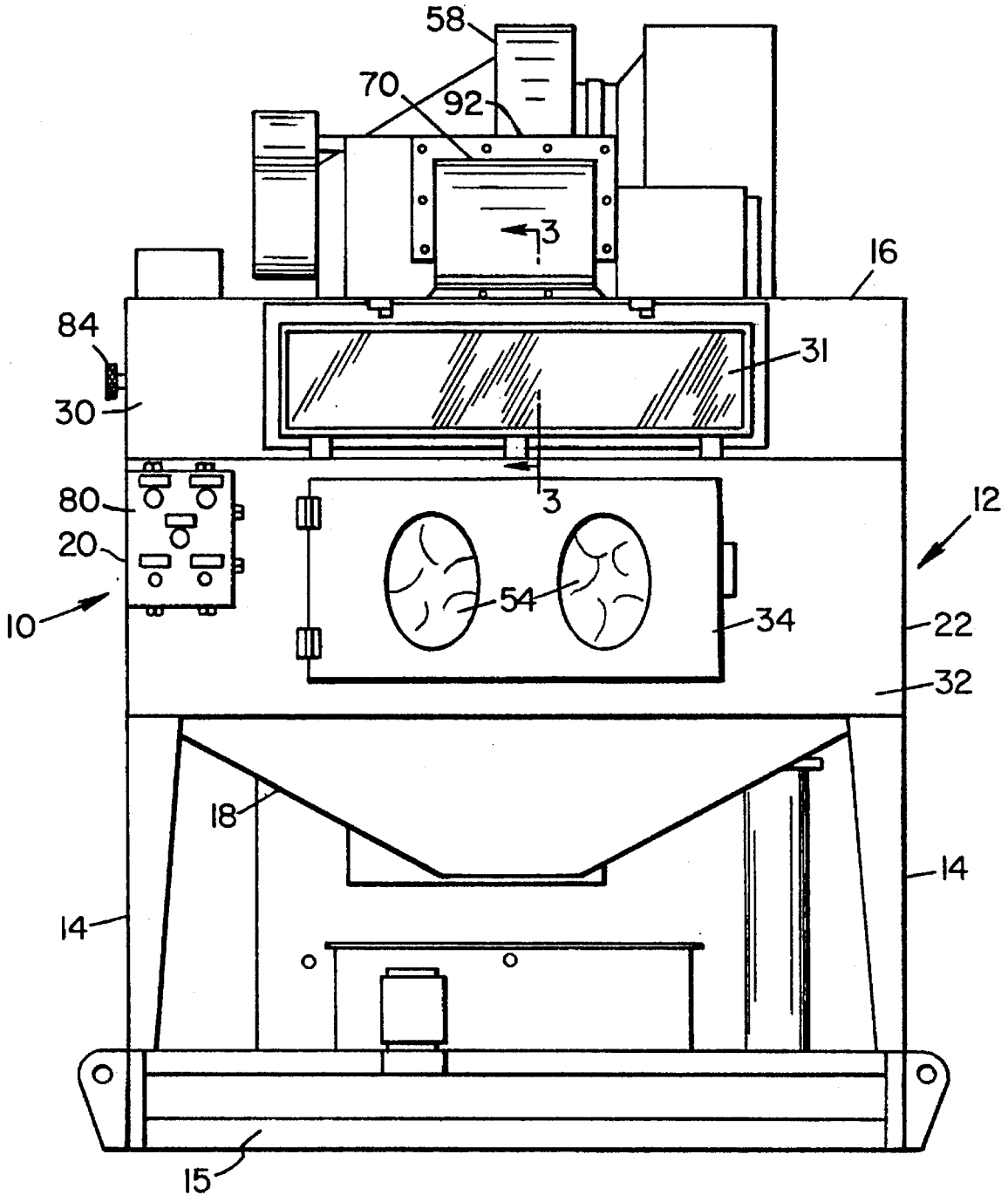
FIG. 1 is a front elevational view of the blast cabinet of this invention including a viewing window and arm holes for the operator.
Figure 2:
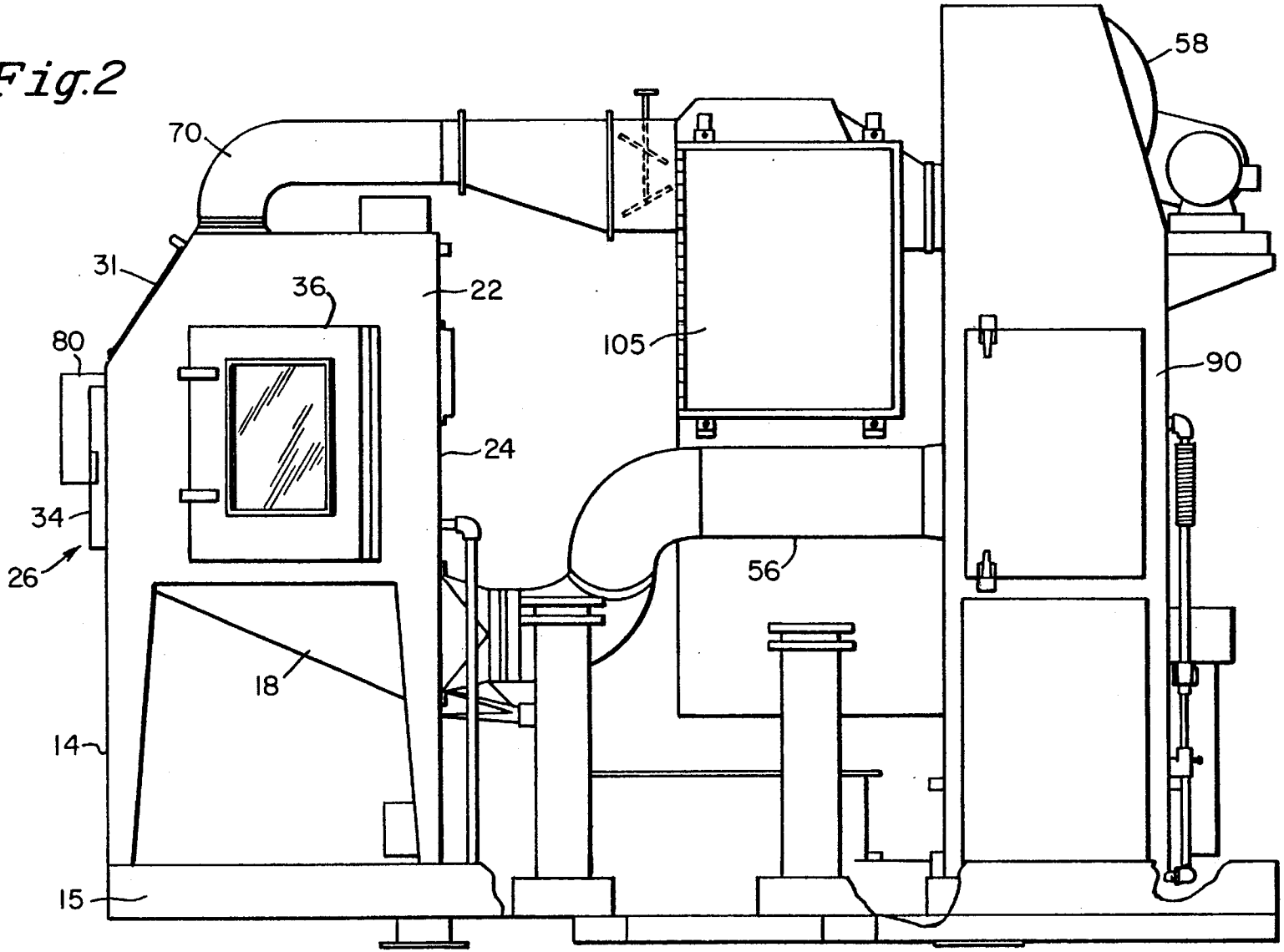
FIG. 2 is a side elevational view of the blast cabinet and ventilation system which circulates air to and from the blast cabinet.
Figure 4:
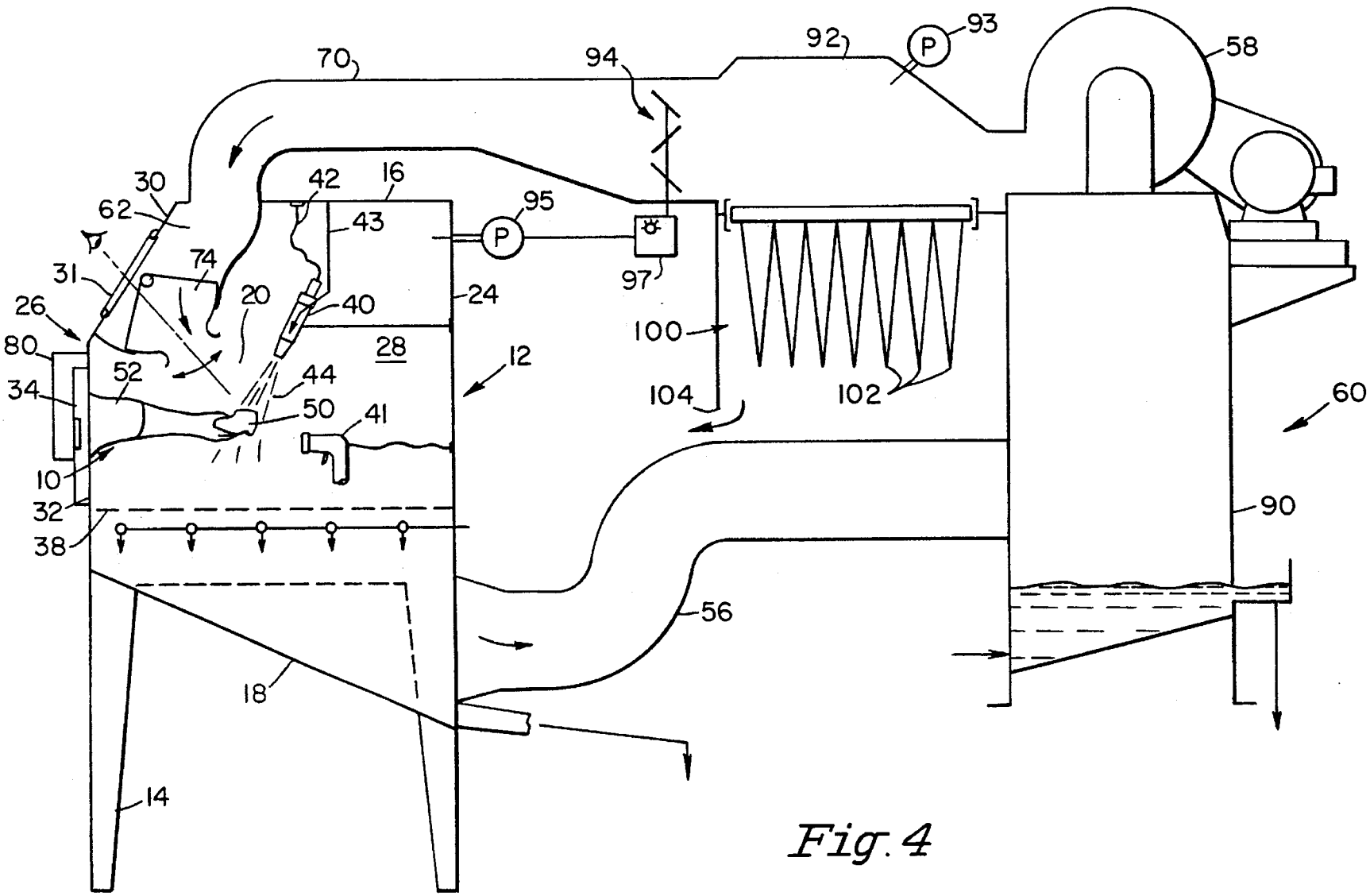
FIG. 4 is a schematic of the blast cleaning system of the present invention showing the blast cabinet and ventilation system including filtering means and recirculating air duct work.

FIGS. 1, 2 and 4 illustrate an abrasive blast cabinet and ventilation system of this invention including a blast cabinet 10 which includes a housing 12 supported on legs 14 and a skid assembly 15. Housing 12 includes a top wall 16, an inverted pyramid-shaped bottom wall 18, opposed side walls 20 and 22, a back wall 24 and a front wall 26, all of which cooperate to define a blast compartment or internal chamber 28. The front wall 26 has an inclined upper portion 30 containing window 31 and a vertical lower portion 32 including a hinged access door 34. In the specific construction illustrated, the blast cabinet 10 also includes a hinged side access door 36 in the side wall 22. The access doors 34 and 36 an be opened for access to the blast chamber 28 for inserting and removing articles to be cleaned and both are sealingly closed during operation of the blast cabinet 10.

Disposed in the lower portion of the blast chamber 28 is a perforated platform or floor 38 for temporarily supporting articles to be cleaned and preventing them from being dropped into the hopper formed by the bottom wall 18. It also can be used to support fixtures for holding parts to be blasted with a mobile nozzle. A pressure-type blast nozzle 40 is suspended from the top wall 16. As explained in more detail below, a pressurized stream of air containing a blast media is delivered to the blast nozzle 40 via a conduit or hose 42 and, when a wet blast media is desired, water or another suitable liquid is delivered to the blast nozzle 40 via a conduit to hose 43. A high velocity, pressurized jet stream 44 of air containing dry blast media or containing a mixture of blast media and water is discharged form the blast nozzle 40. A water nozzle assembly 41 can also be included within chamber 28 to rinse dust from the surface of the article being cleaned.

The interior of the blast chamber 28 may be illuminated by a plurality of flood lights (not shown) which can be installed in support brackets mounted on the top wall 16. An article 50 to be cleaned is held in the jet stream 44 by an operator with a pair of flexible, protective gloves 52 (one shown in FIG. 4) extending from arm holes 54 in the front access door 34. As best shown in FIG. 4, used or spent blast media dispersed in the blast chamber 28 is withdrawn therefrom by a ventilation system including an exhaust conduit 56 connected to the bottom of the housing 12 and a suction or exhaust fan 58 mounted for communication therewith.

Located at the front of the blast cabinet 10 is usually a foot pedal control (not shown) of conventional design which an operator can depress to control the flow of blast media-containing air to the blast nozzle 40.

The construction described up to this point is for the most part, conventional for abrasive blast cabinets employing hard abrasive media such as chilled iron grit or aluminum oxide grit. If a dry, powder abrasive material, such as a sodium bicarbonate-based blast media, is used at a pressure higher than about 30 psi, the interior of the blast chamber 28 becomes completely filled with dust-like spent blast media, making it impossible for an operator to observe an article being cleaned. If a pressurized stream of air containing a mixture of blast media and water is used as the blast media, the interior of the blast chamber 28 becomes filled with fine droplets of water in the form of a mist which also obscures an operator's observation of the article being cleaned.

Figure 3:
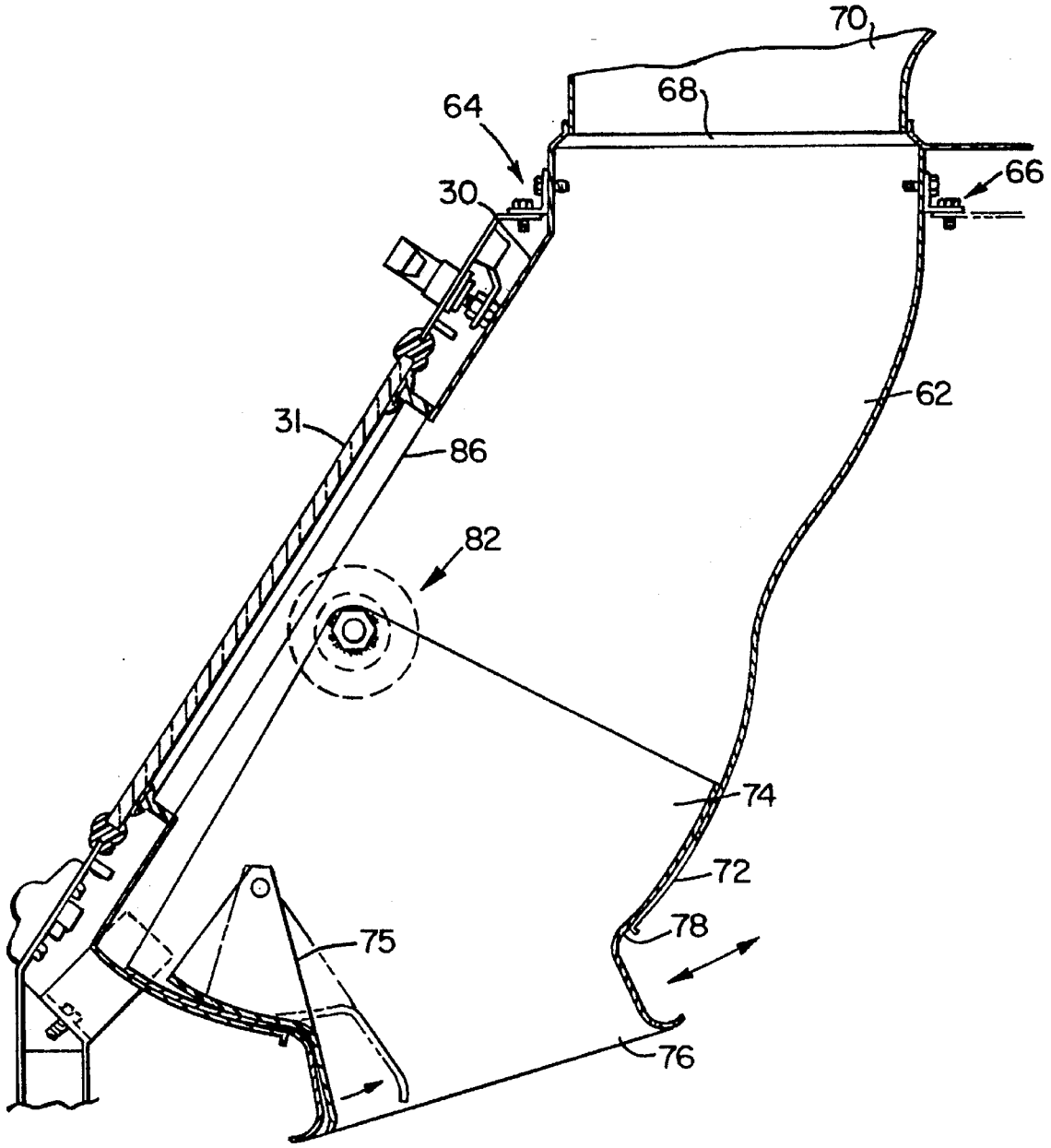
FIG. 3 is cross-sectional view of the interior of the blast cabinet taken along line 3—3 of FIG. 1 and showing the fixed chute and swivel chute means which direct the gas into the viewing zone to remove accumulated dust therein.

In accordance with the invention, the inability to see an article being cleaned is eliminated, or at least minimized, by providing a gas delivery means for directing a flow of gas into a viewing zone in the vicinity of the article being cleaned and purging away a sufficient amount of the spent blast media or mist to facilitate observation of at least that portion of the article being cleaned. In the embodiment illustrated in FIGS. 1, 3 and 4, provided for this purpose is an observation means designed to both focus the operator's line of sight on the article being cleaned and concentrate a flow of air toward the viewing zone to purge away spent blast media or mist dispersed inside the blast chamber 28 away from the viewing zone.

More particularly, the observation means includes an elongated fixed chute 62 supported in the interior of cabinet 10 by means of angle frame assemblies 64 and 66 along the inclined upper portion 30 of front wall 26. Fixed chute 62 has an open upper end 68 which communicates with air duct 70 which recirculates filtered air into the blast cabinet. Fixed chute 62 also includes an open lower end 72 which is open to internal chamber 28 of blast cabinet 10 adjacent the viewing zone. Secured for rotation on the lower end 72 of fixed chute 62 is a swivel chute 74 which has an outlet 76 which protrudes through the opening 78 in fixed chute 62 and serves as an inner viewing port located adjacent a viewing zone 80 in the vicinity of the article 50 being cleaned. Swivel chute 74 is secured for rotation on fixed chute 62 by means of a pair of lock nut, bolt and washer assemblies 82 (one shown) on each side of fixed chute 62. Rotating knob 84 passing through side wall 20 of cabinet 10 and disposed thereon allows the operator to rotate swivel chute 74 to adjust the viewing zone 80 within chamber 28. The fixed chute 62 also has an open portion 86 juxtaposed on the interior of window 31 placed on inclined upper portion 30 of cabinet 10. Opening 86 is at least as wide as window 31 as particularly shown in FIG. 3 so that an operator standing outside blast cabinet 10 can direct his or her line of sight through the interior of fixed chute 62 and swivel chute 74 and observe the article 50 being blast cleaned, see FIG. 4. By rotating swivel chute 74 to change the location of outlet 76 and by altering the line of sight through window 31, the operator can observe a large portion of internal chamber 28. This allows the operator to manipulate the article 50 being cleaned within the chamber 28 and not lose sight of the blast cleaning operation.

A gas delivery means including fixed chute 62 and swivel chute 74 is provided for delivering a flow of air or other gas into chamber 28 of cabinet 10 for discharge from the outlet 76 in a direction toward the viewing zone 80 and at a velocity and volume sufficient to purge spent blast media, normally dispersed in the viewing zone 80, away from at least that portion of the article being cleaned.

Specifically, the gas delivery means is part of the air ventilation system for blast cabinet 10. In general, dust-laden air from the bottom 18 of cabinet 10 is drawn into duct 56 which communicates with a primary filtering unit 90. Air flow through duct 56 is maintained by fan 58 which withdraws the dust laden air from the interior of cabinet 10 into duct 56 and into filtering unit 90. The air or other gas leaving filtering unit 90 has been cleaned of a majority of the abrasive dust contained therein but is sufficiently contaminated with dust that the air cannot be directly purged into the ambient atmosphere. In accordance with the present invention, fan 58 directs the air from filtering unit 90 through duct 92 which communicates with duct 70 and the open end 68 of fixed chute 62. Fan 58 is operated in a manner to withdraw sufficient air from cabinet 10 and direct the air from filtering unit 90 to duct 70 and fixed chute 62 at a sufficient velocity and volume to blow or purge a sufficient amount of the spent blast media or mist away from article 50 to facilitate observation of at least that part of the article 50 being cleaned. Importantly, the outlet 76 of swivel chute 74 is configured in the form of a venturi such that the air or other gas being directed by fan 58 into fixed chute 62 and swivel chute 74 is accelerated as it passes from slight constriction 75 into the expanding outlet 76 of swivel chute 74. The acceleration aids in the purging and removal of the abrasive dust from the viewing zone.

As used herein, the terms "purge" and "purging" means deflecting, diverting or otherwise physically displacing a substantial amount, but not necessarily all, of the spent blast or other cleaning media normally dispersed in the viewing zone in the vicinity of the article being cleaned, away from the viewing zone so that the article can be observed. The air or other gas which is recirculated from the bottom of cabinet 10, through scrubber 90 and into ducts 92, 70 and, finally, through fixed chute 62 and swivel chute 74 is not free of dust but the dust is so finely dispersed within the air flow that the dust does not hinder the vision of the operator.

The blast cabinet system of the present invention employing a blast cabinet 10 of the invention will include a supply system (not shown) for delivering an abrasive media such as a powder sodium bicarbonate-based blast media to the blast cabinet. A particularly useful supply system is the Accustrip® supply system marketed by Church and Dwight. The blast nozzle 40 and the remainder of the supply system are arranged to deliver either a pressurized stream of air containing dry blast material or a pressurized stream of air containing a mixture of blast media and water. The Accustrip® supply system is the subject matter of commonly assigned U.S. Pat. Nos. 5,081,799 and 5,083,402. Such a system includes a supply hopper for the blast media which is pressurized. Means are provided for adjusting the pressure maintained on the blast media in the supply hopper. Compressed air is supplied to the blast nozzle via a pressurized regulator for adjusting the blast pressure. A mixing valve is provided for adjusting the amount of blast media delivered to the compressed air stream to the blast nozzle. The pressure on the blast media in the supply hopper and the compressed air pressure to the blast nozzle are adjusted to maintain a predetermined differential pressure between the pressure applied on the blast media and the blast pressure. The system can also include a pump connected to a water supply for controlling the flow of water to the blast nozzle 40 via hose 43. U.S. Pat. Nos. 5,081,799 and 5,083,402 are herein incorporated by reference.

The ventilation system for removing spent blast media from the blast chamber 28 can be described in more detail by referring to FIGS. 2 and 4. The ventilation system of this invention includes primary filter unit 90, fan 58, secondary or polishing filtering system 100, duct 56 which carries dust-laden air from the bottom of blast cabinet 10 and ducts 92 and 70 which recycle filtered air from filter unit 90 to fixed chute 62. Preferably, primary filter unit 90 for removing a majority of the dust from the dust-laden air which is recovered from blast cabinet 10 comprises a wet scrubber while polishing filtering system 100 comprises bag filters 102.

In the preferred operation, the dust-laden air is first passed through filter unit 90 or a wet scrubber in which a wall of water collects most of the dust and removes same from the air. Although any type of filtering means can be used for primary filter 90 a wet scrubbing filter is preferred. The primary filter should be able to remove at least 95% of the dust from the air and, preferably, remove at least 99% of the dust. A particularly preferred wet scrubbing filter which can be used is the Roto-Clone®, type N from American Air Filter Co., Inc. Louisville, Kentucky. The suction side of exhaust fan 58 communicates with the interior of the wet scrubbing filter 90 and sucks air from the bottom of blast cabinet 10 through duct 56 and into the scrubbing zone of the filter 90. The air which passes through the water is cleaned of approximately 99+% of the dust which was contained in the air passing through duct 56.

Under the stricter clean air regulations which are now present, even air which contains just 1% dust is not clean enough to be purged into the ambient atmosphere. Accordingly, in accordance with the present invention, this filtered air is recycled to the blast cabinet in sufficient amounts and velocity so as to purge the viewing zone 80 of dust which is dispersed therein and obscures the view of the article being cleaned from the operator. Thus, exhaust fan 58 blows the filtered air from primary filter unit 90 into duct 92 which communicates with duct 70 which itself communicates with the open end 68 of fixed chute 62 in blast cabinet 10. The small amount of dust which is contained in the recycled air does not obstruct the operator's vision of the article being cleaned.

Since recycled air is being introduced into blast cabinet 10 along with the pressurized air from blast nozzle 40, there needs to be an accurate control of the air pressure within cabinet 10 to insure that the recycled air is at a sufficient velocity and volume to purge dust away from the viewing zone 80 and at the same time not cause excessive pressure to exist within cabinet 10 so as to cause leakage of the dust from the front and sides of cabinet 10 to contaminate the atmosphere around blast cabinet 10. Thus, it has been found that a small vacuum of approximately 0.25 to 1.0 inch $H_2O$ should be maintained in the interior 28 of cabinet 10. The vacuum creates air flow through the viewing zone 80 and is directly related to the air velocity and the ability of the air to purge the dust away from such viewing zone. To provide maintenance of the small vacuum within blast cabinet 10, an air control system is provided. In one embodiment of the air control system, a damper assembly 94 is provided between ducts 92 and 70. Thus, the damper assembly 94 can be closed to reduce the amount of recycled air which enters fixed chute 62 and maintain the vacuum in chamber 28. In conjunction with damper assembly 94, secondary or polishing filter 100 including bag filters 102 are used to filter the dust from the excess air which is not recycled to blast cabinet 10. Thus, the damper assembly 94 causes the excess air to be directed through the secondary filter assembly 100 where the dust is collected in the interior of filter bags 102 and the dust-free air passes through outlet 104. The air passing through outlet 104 has been twice filtered and now meets all clean air standards and can be safely directed into the ambient atmosphere. To accurately control the air pressure (vacuum) within blast cabinet 10, two pressure gauges are provided including pressure gauge 93 situated at the inlet of the polishing filter 100 and pressure gauge 95 which measures the air pressure within internal chamber 28 of blast cabinet 10. In operation, if pressure gauge 95 indicates that there is an insufficient vacuum in blast cabinet 10, the damper assembly 94 can be controlled to reduce the amount of recirculated air passing through duct 70 and eventually into fixed chute 62. Damper assembly 94 can be controlled automatically as shown by control system 97 in FIG. 4 or manually controlled by levers (not shown) placed in duct 92. By closing the damper assembly 94 less air is directed into chamber 28 maintaining the small vacuum therein and more air is directed into the polishing filter 100 for cleaning and for purging into the ambient atmosphere. As the bag filters are filled there is a pressure build up in duct 92. Accordingly, the damper assembly 92 has to be consistently closed to limit the amount of air passing into chamber 28. If pressure gauge 93 indicates that there is too much of a build up of pressure at the inlet of the polishing filter 100, this is an indication that the bag filters 102 are filled to capacity. Reducing the opening of damper assembly 94 is then no longer useful to prevent air flow and, accordingly, at this time the bag filters should be changed. The bag filters 102 can be removed from the system via access door 105. It has been found useful to utilize a fan which has a capacity of about 1600 standard cubic feet per minute. Approximately 200 cubic feet per minute is diverted by the damper assembly 94 into the polish filtering system 100.

An alternative to damper assembly 94 for controlling air flow into chamber 28 and for maintaining the small vacuum therein is shown in FIG. 3. Thus, swivel chute 74 can be configured such that the opening of outlet 76 can be reduced to limit air flow therethrough. As shown in FIG. 3, pivot assembly 75 containing outlet flange 77 can be pivotally mounted on the swivel chute to reduce the opening of outlet 76. Other means can be used to limit and reduce the opening of outlet 76. For example, swivel chute 74 itself may be formed of two components which fit within each other and are pivotally mounted by assembly 82 to not only move in unison to change the viewing zone but able to close within each other to reduce the opening in outlet 76. With either means, the object is to maintain the desired pressure (vacuum) inside chamber 28.

The spent blast media containing the materials cleaned from the article 50 collecting in wet scrubber 90 and polish filter assembly 100 can be periodically removed for disposal. In many cases, the spent media can be disposed of by sanitary land fill. In cases where the material removed during cleaning requires special handling, a sufficient amount of water can be added to the spent media to solubilize the sodium bicarbonate. The undissolved material, which typically represents about 1% of the spent media includes such things as paint chips, grease, oil and the like can be separated by filtering and disposed of in a hazardous land fill. The remainder is dissolved sodium bicarbonate and water and, because of the nontoxic nature of sodium bicarbonate, often can be sewered with waste treatment plant approval.

What is claimed is:

1. A blast cabinet for cleaning surfaces of articles with an abrasive blast media comprising:

a housing defining a blast chamber with an interior;

a blast nozzle disposed in said blast chamber interior and connected to a source of an abrasive blast media for directing a flow of the blast media against a surface of an article to be cleaned in said blast chamber interior whereby said blast media normally is dispersed throughout said blast chamber interior in a manner so as to obscure visual observation of a portion of the article being cleaned from outside said blast chamber;

observation means for observing the article being cleaned in said interior including a window placed in said housing and an inner viewing port situated in the vicinity of but spaced from the article to be cleaned to provide a viewing zone between said inner viewing port and the article to be cleaned, so that an operator outside said blast chamber can direct his or her line of sight through said window and said inner viewing port and observe the article being cleaned;

gas delivery means in fluid communication with said inner viewing port for directing a flow of gas into said viewing zone for purging away a sufficient amount of blast media dispersed in said viewing zone to facilitate observation through said window and said inner viewing port of at least a portion of said article being cleaned, ventilation means to remove spent blast media and air from said interior of said housing, and, air supply means to recycle said air removed from the interior to said gas delivery means for directing said recycled air into the interior of said blast cabinet as said flow of gas into said viewing zone, said gas delivery means including a fixed chute place in said interior adjacent said window, said fixed chute including a first open end in communication with said air supply means, an opening adjacent said window and a second open end communicating with said inner viewing port, said inner viewing port being rotatable about said second open end of said fixed chute.

2. The blast cabinet of claim 1 wherein said inner viewing port includes an open-ended swivel chute secured to said second open end of said fixed chute.

3. The blast cabinet of claim 2 wherein said swivel chute includes a first opened end attached to said fixed chute and a second opened end facing said viewing zone, said swivel chute including a restriction immediately upstream of said second opened end whereby said restriction and said second opened end of said swivel chute comprises a venturi whereby gas passing through said swivel chute is accelerated as said gas passes through said restriction and said second opened end.

4. The blast cabinet of claim 2 further including means to reduce the amount of recycled air being passed into said viewing zone.

5. The blast cabinet of claim 4 wherein said recycled air reducing means includes means to reduce the opening of said open end of said swivel chute.

6. The blast cabinet of claim 1 including a primary filtering means for filtering said air removed from said interior to remove spent media prior to recycle into said blast cabinet.

7. The blast cabinet of claim 6 wherein said primary filtering means includes a wet scrubber wherein said air removed from said interior and containing spent media is passed through a liquid to capture said media.

8. The blast cabinet of claim 6 including a polishing filter means downstream of said primary filtering means wherein at least a portion of said filtered air is directed from said primary filtering means into said polishing filter means.

9. The blast cabinet of claim 8 wherein said polishing filter means comprises bag filters.

10. The blast cabinet of claim 8 including means to reduce the amount of said filtered air from said primary filtering means that is recycled into said viewing zone.

11. The blast cabinet of claim 10 wherein said air supply means is a duct in fluid communication with each of said primary filtering means, said polishing filter means and said gas delivery means and said ventilation means comprises a fan for directing recycled air through said duct, said recycled air reducing means being a damper assembly placed within said duct.

12. The blast cabinet of claim 11 including means to measure the gas pressure in the interior of said cabinet.

13. The blast cabinet of claim 12 further including means to measure the gas pressure in said duct adjacent said polishing filter means.

14. The blast cabinet of claim 6 including means to measure the gas pressure in the interior of said cabinet.

15. The blast cabinet of claim 1 including means to reduce the amount of recycled air being passed into said viewing zone.

16. A blast cabinet for cleaning surfaces of articles with an abrasive blast media comprising:

a housing defining a blast chamber with an interior;

a blast nozzle disposed in said blast chamber interior and connected to a source of an abrasive blast media for directing a flow of the blast media against a surface of an article to be cleaned in said blast chamber interior whereby said blast media normally is dispersed throughout said blast chamber interior in a manner so as to obscure visual observation of a portion of the article being cleaned from outside said blast chamber;

observation means for observing the article being cleaned in said interior including a window placed in said housing to provide a viewing zone between said window and the article to be cleaned, so that an operator outside said blast chamber can direct his or her line of sight through said window and observe the article being cleaned;

gas delivery means directing a flow of gas into said viewing zone for purging away a sufficient amount of blast media dispersed in said viewing zone to facilitate observation through said window of at least a portion of said article being cleaned, ventilation means to remove spent blast media and air from said interior of said housing, and, air supply means to recycle said air removed from the interior to said gas delivery means for directing said recycled air into the interior of said blast cabinet as said flow of gas into said viewing zone, wherein said air supply means is a duct in fluid communication with said gas delivery means, said ventilation means comprising a fan for directing recycled air through said duct, a movable damper assembly being placed within said duct to control the amount of recycled air being passed into said viewing zone.

17. The blast cabinet of claim 16 including a primary filtering means for filtering said air removed from said interior to remove spent media prior to recycle into said blast cabinet.

18. The blast cabinet of claim 17 wherein said primary filtering means includes a wet scrubber wherein said air removed from said interior and containing spent media is passed through a liquid to capture said media.

19. The blast cabinet of claim 17 including a polishing filter means downstream of said primary filtering means wherein at least a portion of said filtered air is directed from said primary filtering means into said polishing filter means.

20. The blast cabinet of claim 19 wherein said polishing filter means comprises bag filters.

21. The blast cabinet of claim 20 wherein said duct is in communication with each of said primary filtering means and said polishing filter means.

22. A blast cabinet for cleaning surfaces of articles with an abrasive blast media comprising:

a housing defining a blast chamber with an interior;

a blast nozzle disposed in said blast chamber interior and connected to a source of an abrasive blast media for directing a flow of the blast media against a surface of an article to be cleaned in said blast chamber interior whereby said blast media normally is dispersed throughout said blast chamber interior in a manner so as to obscure visual observation of a portion of the article being cleaned from outside said blast chamber;

observation means for observing the article being cleaned in said interior including a window placed in said housing and an inner viewing port situated in the vicinity of but spaced from the article to be cleaned to provide a viewing zone between said inner viewing port and the article to be cleaned, so that an operator outside said blast chamber can direct his or her line of sight through said window and said inner viewing port and observe the article being cleaned;

gas delivery means in fluid communication with said inner viewing port for directing a flow of gas into said viewing zone for purging away a sufficient amount of blast media dispersed in said viewing zone to facilitate observation through said window and said inner viewing port of at least a portion of said article being cleaned;

gas supply means communicating with said gas delivery means;

said gas delivery means including a fixed chute placed in said interior adjacent said window, said fixed chute including a first open end in communication with gas supply means, an opening adjacent said window and a second open end communicating with said inner viewing port, said inner viewing port being rotatable about said second open end of said fixed chute.

* * * * *